US005434352A

United States Patent [19]

Miyazawa et al.

[11] Patent Number: 5,434,352

[45] Date of Patent: Jul. 18, 1995

[54] WET RECORDING APPARATUS FOR DEVELOPING ELECTROSTATIC LATENT IMAGES

[75] Inventors: Yoshinori Miyazawa; Hideo Yamazaki; Makoto Fujino, all of Nagano, Japan

[73] Assignee: Seiko Epson Corporation, Tokyo, Japan

[21] Appl. No.: 296,416

[22] Filed: Aug. 26, 1994

Related U.S. Application Data

[62] Division of Ser. No. 775,130, Oct. 11, 1991, Pat. No. 5,387,760.

[30] Foreign Application Priority Data

| | | | |
|---|---|---|---|
| Oct. 19, 1990 | [JP] | Japan | 2-281549 |
| Oct. 19, 1990 | [JP] | Japan | 2-281550 |
| Oct. 19, 1990 | [JP] | Japan | 2-281551 |
| Oct. 25, 1990 | [JP] | Japan | 2-288011 |

[51] Int. Cl.[6] ..... G03G 15/10

[52] U.S. Cl. ..... 118/661; 118/659; 355/256; 355/271; 355/277; 430/117

[58] Field of Search ..... 355/245, 256, 271, 277, 355/77; 118/659, 660, 661; 430/117, 118

[56] References Cited

U.S. PATENT DOCUMENTS

| | | | |
|---|---|---|---|
| 4,258,115 | 3/1981 | Magome et al. | 430/117 X |
| 4,263,391 | 4/1981 | Saito et al. . | |
| 4,284,697 | 8/1981 | Ando et al. . | |
| 4,311,780 | 1/1982 | Mochizuki et al. . | |
| 4,325,627 | 4/1982 | Swidler et al. . | |
| 4,327,664 | 5/1982 | Ohkawa et al. | 118/661 |
| 4,370,663 | 1/1983 | Markham . | |
| 4,373,469 | 2/1983 | Kuge et al. . | |
| 4,421,056 | 12/1983 | Schinke . | |
| 4,627,705 | 12/1986 | Landa et al. . | |
| 4,748,934 | 6/1988 | Mochizuki et al. . | |
| 4,761,357 | 8/1988 | Tavernier et al. | 118/661 X |
| 4,860,050 | 8/1989 | Kurotori et al. | 355/256 |
| 4,899,196 | 2/1990 | Mahoney . | |
| 4,905,047 | 2/1990 | Ariyama . | |
| 4,994,855 | 2/1991 | Ohashi et al. . | |
| 5,010,370 | 4/1991 | Araya et al. . | |
| 5,017,968 | 5/1991 | Oikawa . | |
| 5,128,721 | 7/1992 | Uematsu . | |
| 5,148,222 | 9/1992 | Lior et al. . | |
| 5,155,500 | 10/1992 | Kondo . | |
| 5,155,534 | 10/1992 | Kurotori et al. | 355/256 |

FOREIGN PATENT DOCUMENTS

| | | |
|---|---|---|
| 0399186 | 11/1990 | European Pat. Off. . |
| 55120058 | 2/1954 | Japan . |
| 44-23792 | 10/1969 | Japan . |
| 62-51466 | 10/1987 | Japan . |
| 63-84394 | 6/1988 | Japan . |
| WO9008984 | 8/1990 | WIPO . |
| WO9014619 | 11/1990 | WIPO . |

OTHER PUBLICATIONS

JP2091670, dated Mar. 30, 1990; Patent Abstracts of Japan.

JP5518869, dated Nov. 21, 1980; Patent Abstracts of Japan.

JP1205187, dated Aug. 17, 1989; Patent Abstracts of Japan.

*Primary Examiner*—A. T. Grimley
*Assistant Examiner*—Sandra L. Brasé
*Attorney, Agent, or Firm*—Sughrue, Mion, Zinn, Macpeak & Seas

[57] ABSTRACT

A wet development apparatus for a recording machine for developing a toner image corresponding to an electrostatic latent image on an electrostatic latent image carrier using a wet developer. The apparatus includes a development roller disposed in contact with or near the electrostatic latent image carrier and an application head for applying a uniform layer of the wet developer to the roller.

5 Claims, 11 Drawing Sheets

255
D
E
311
320
322
330
F
325
321
323
324
272
70
66
69
53
65
64
68
67
63
62
57
56
74
75
51
59
62
61
60
C
58

WET RECORDING APPARATUS FOR DEVELOPING ELECTROSTATIC LATENT IMAGES

This is a divisional of application Ser. No. 775,130, filed Oct. 11, 1991, now U.S. Pat. No. 5,387,760.

BACKGROUND OF THE INVENTION

The present invention relates to a wet development apparatus for a recording machine such as an electrophotographic copying machine or an electrophotographic printer, and which is used to render visible an electrostatic latent image using a wet developer composed of an electrically insulating carrier liquid and charged grains dispersed in the liquid.

In a conventional wet development apparatus, an electrostatic latent image carrier is moved along a pan-shaped electrode containing a developer so that the developer is applied to the carrier, as disclosed in, for example, an Examined Japanese Patent Publication No. 51466/87. In another type of a conventional wet development apparatus, as disclosed in Examined Japanese Patent Publication No. 23792/69, a development section and a developer tank are connected to each other through a vacuum pump so that a developer is circulated out of a slender opening of the development section.

In Unexamined Japanese Utility Model Publication No. 84394/88, an image is developed by discharging a developer from a slot of an electrode plate, which is opposed to an electrostatic latent image carrier across a small gap, so that charged grains cling to the carrier due to an electric field between the carrier and the electrode plate.

In Unexamined Japanese Utility Model Publication No. 120058/80, a developing method, in which an elastic roller is brought in pressure contact with a photosensitive drum, is taught. A developer is carried to the photosensitive drum in such a manner that the elastic roller is dipped into the developer accommodated in a developer tank so as to adhere the developer onto the outer peripheral surface of the elastic roller.

In the above-mentioned conventional wet development apparatus, a developer, having a low density, accommodated in a developer tank is supplied in such a manner that a photosensitive drum is dipped into the developer in the tank, so that a vapor of a carrier liquid in the developer is discharged into the atmosphere. A bad odor is generated from the vapor, so that an environment is influenced by the odor.

In the above-mentioned conventional wet recording machines, the coloring agent of the wet developer, which is generally constituted by charged grains of a toner made of a pigment and a resin, clings to the electrostatic latent image carrier through electrophoresis. Therefore, a large amount of developer is needed for development. This creates a problem in that a large space is required for storing the developer, particularly the carrier liquid portion. Accordingly, a large wet development apparatus is required. Since the electrophoretic velocity of the coloring agent depends on the viscosity of the developer, the viscosity must be kept low to make the velocity high. For this reason, the charged grains of the toner need to be dispersed in a large quantity of a carrier liquid to make the viscosity of the developer low. Since the carrier liquid does not participate in finally forming a visible image on recording paper, the liquid needs to be evaporated or be recovered and discarded. This creates yet another problem.

If development is to be performed with different color developers in the conventional development apparatus, the development device of the apparatus needs to be provided with a "put-aside" mechanism for changing the different color development devices, which operation is time consuming. This too is a problem.

SUMMARY OF THE INVENTION

Accordingly, it is a general object of the present invention to provide a wet development apparatus wherein the quantity of developer necessary for development is reduced and which is free of the above-mentioned problems and disadvantages.

It is another object of the invention to provide a wet development apparatus which is capable of developing a plurality of colors and in which the development means of the apparatus does not need to be provided with a "put-aside" mechanism for moving the development means aside when the development colors are changed.

It is also object of the invention to provide a wet development apparatus which capable of decreasing an amount of the vapor of a carrier liquid in a developer which is discharged into the atmosphere. In the construction of the present invention, the developer is supplied to the development section is a closed system, so that it is possible to use a developer having a high density in which a rate of the carrier liquid is small. Therefore, it is not necessary to use a developer tank having a large liquid evaporation surface, so that an amount of the vapor to be generated can be decreased.

In accordance with the above and other objects, the present invention provides a wet development apparatus for developing an electrostatic latent image on an electrostatic latent image carrier using a wet developer, which includes a development roller for transferring the wet developer to the carrier, and developer application means for uniformly applying the developer to the roller.

Further in accordance with the above objects, the present invention provides a wet development apparatus for developing an electrostatic latent image on an electrostatic latent image carrier using a wet developer, which includes a development roller for transferring the wet developer to the carrier, developer application means for uniformly applying the developer to the roller, a development roller cleaning member which is placed in contact with the development roller to remove excess wet developer from the roller, and a device for placing the development roller cleaning member out of contact with the development roller.

Yet further, the invention provides a wet recording machine for forming a toner image corresponding to an electrostatic latent image on an electrostatic latent image carrier using a wet developer, comprising: an elastic drum which is in rotatable contact with the image carrier, the elastic drum including a tube and an elastic layer provided on the peripheral surface thereof, and a developer application means for applying the wet developer to an electroconductive portion of the elastic drum at the position where the drum contacts the carrier thereby forming the toner image on the carrier, wherein a first imaginary line connecting the centers of the electrostatic latent image carrier and the elastic drum, and a second imaginary line connecting the centers of the elastic drum and the pressure roller do not form a 180 degree angle.

Even further, the invention provides a wet development apparatus for developing an electrostatic latent image on an electrostatic latent image carrier using a wet developer, including wet developer application means for applying the wet developer to the carrier, a development roller which is in rotatable contact with the carrier and which comprises an electroconductive substance provided with an electrically-insulating outermost layer, the development roller being kept at a predetermined potential and being rotated at the same speed as the carrier, wherein the wet developer is applied to the carrier by the application means and any wet developer not corresponding to the electrostatic latent image is removed by the development roller, the removed wet developer remains upstream of the place where the carrier and the development roller come into contact with each other.

Yet even further, the invention provides a wet recording method for recording a toner image on to a recording paper using a wet developer, including the steps of: forming an electrostatic latent image on an electrostatic latent image carrier, rotating an elastic drum which is in contact with the carrier, applying a predetermined potential to an electroconductive portion of the elastic drum, spraying wet developer to a position where the carrier and the elastic drum come into contact with each other, forming a toner image on the drum which corresponds to the electrostatic image on the carrier, placing a recording material into contact with the elastic drum, applying pressure to the paper by a pressure roller to place the paper into contact with the drum, and transferring the toner image to the paper.

In a wet development apparatus provided in accordance with the present invention, an electrostatic latent image on an electrostatic latent image carrier is developed with a wet developer. The apparatus is characterized by including a development roller which is disposed in contact with the electrostatic latent image carrier or faces it across a small clearance and which carries the developer to the carrier; and at least one developer application means for uniformly applying the developer to the roller.

In another wet development apparatus provided in accordance with the present invention, an electrostatic latent image on an electrostatic latent image carrier is developed with a wet developer. The apparatus is characterized by including a development roller which is disposed in contact with the carrier or faces it across a small clearance and which carriers the developer to the carrier; at least one developer application means for uniformly applying the developer to the roller; and a development roller cleaning member which is put in contact with the roller so that the developer applied to the roller is removed therefrom by the member.

In yet another wet development apparatus provided in accordance with the present invention, an electrostatic latent image on an electrostatic latent image carrier is developed with a wet developer. The apparatus is characterized by including a development roller which is disposed in contact with the carrier or faces it across a small clearance and which carries the developer to the carrier; at least one developer, application means for uniformly applying the developer to the roller; a development roller cleaning member which is put in contact with the roller so that the developer applied to the roller is removed therefrom by the member; and a mechanism for putting the cleaning member out of contact with the roller.

In the wet recording machine provided in accordance with the present invention, an electrostatic latent image on an electrostatic latent image carrier is developed with the wet developer so that a toner image is formed. The machine is characterized in that an elastic drum including an electroconductive portion kept at a prescribed potential, and an elastic layer, which comes into contact with the electrostatic latent image carrier, are provided; and the developer is fed to the place where the carrier and the drum come into contact with each other, so that the toner image is formed on the drum depending on the latent image on the carrier.

In the wet recording machine provided in accordance with the present invention, the wet developer is applied to the electrostatic latent image carrier by a mechanical force, and an intense electric field acts on the wet developer at the place of mutual contact of the carrier and the elastic drum in dependence on the electrostatic latent image on the carrier. Accordingly, the wet developer does not need to be kept low in viscosity and high in mobility by using a large quantity of a carrier liquid.

In the wet recording machine provided in accordance with the present invention, an electrostatic latent image on an electrostatic latent image carrier is developed with the wet developer and then transferred to the recording paper so that the toner image is formed thereon. The machine is characterized in that the electrostatic latent image carrier, an elastic drum having an electroconductive portion, which is kept at a prescribed potential, an elastic layer, which is in contact with the carrier, and a pressure roller for applying pressure to the recording paper on the drum are included; the wet developer is fed to the place where the carrier and the drum come into contact with each other, so that the toner image is formed on the drum depending on the electrostatic latent image on the carrier; the recording paper is put into contact with the drum; and pressure is applied to the paper on the drum so that the toner image is transferred from the drum to the paper. It is noted that not all of the centers of the electrostatic latent image carrier, the elastic drum, and the pressure roller need be located on an imaginary straight line.

Since the wet developer is applied to the electrostatic latent image carrier of the wet recording machine provided in accordance with the present invention and an intense electric field acts at the place of mutual contact of the carrier and the elastic drum in dependence on the electrostatic latent image, the wet developer does not need to be kept low in viscosity and high in mobility by a large quantity of a carrier liquid. Since the toner image is directly transferred from the drum to the paper, the transfer mechanism of the machine is simplified and the quality of the toner image does not deteriorate.

An electrostatic latent image on an electrostatic latent image carrier is developed with the wet developer by the wet development apparatus provided in accordance with the present invention. The apparatus is characterized in that a wet developer application means is provided to drive out the wet developer to apply it to the carrier; a development roller which is made of an electroconductive substance or which is made of an electroconductive substance and has an electrically-insulating outermost layer is provided so that the roller is kept at a prescribed potential and moved at the same speed as the carrier in contact therewith; the wet developer applied to the carrier by the means is removed by the roller depending on the electrostatic latent image so that the image is made visible; and the removed developer stays upstream of the place where the carrier and the roller come into contact with each other.

Since the wet developer is applied to the electrostatic latent image carrier by a mechanical force in the wet development apparatus provided in accordance with the present invention, the carrier liquid of the developer does not need to be made large in quantity to keep the developer low in viscosity and high in mobility.

DESCRIPTION OF THE PREFERRED EMBODIMENTS

Preferred embodiments of the present invention are hereafter described with reference to the accompanying drawings.

Figure 1:
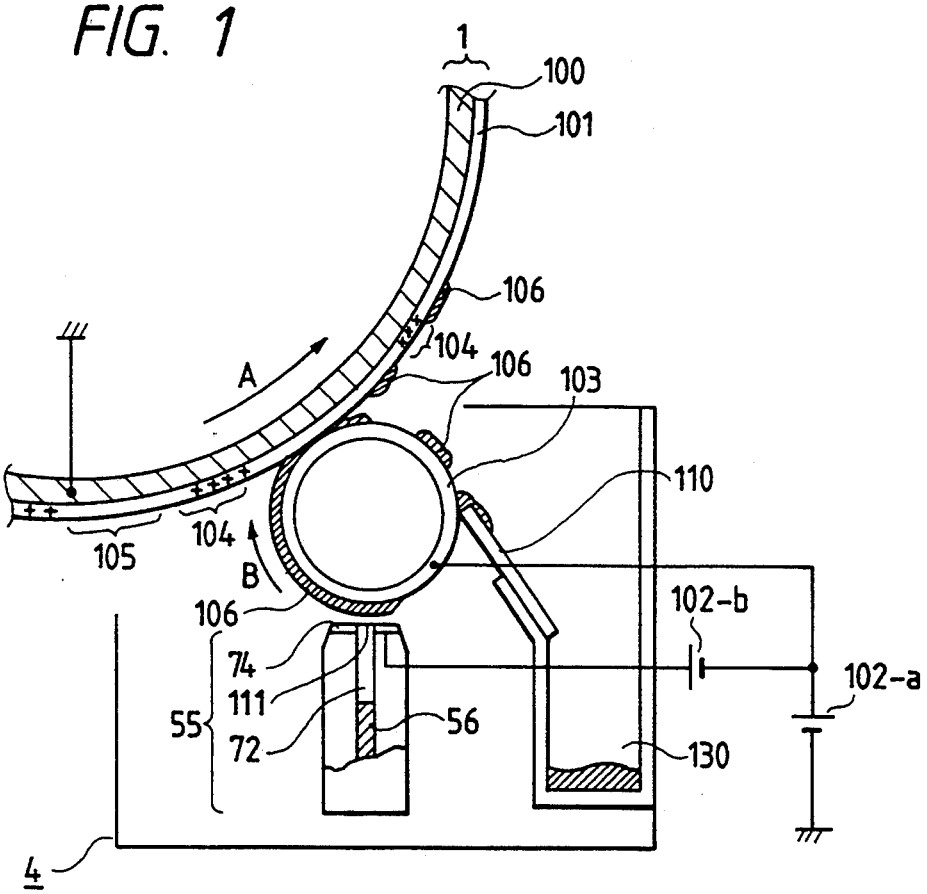
FIG. 1 is a structural view of a wet development apparatus in accordance with one embodiment of the invention.
Figure 2:
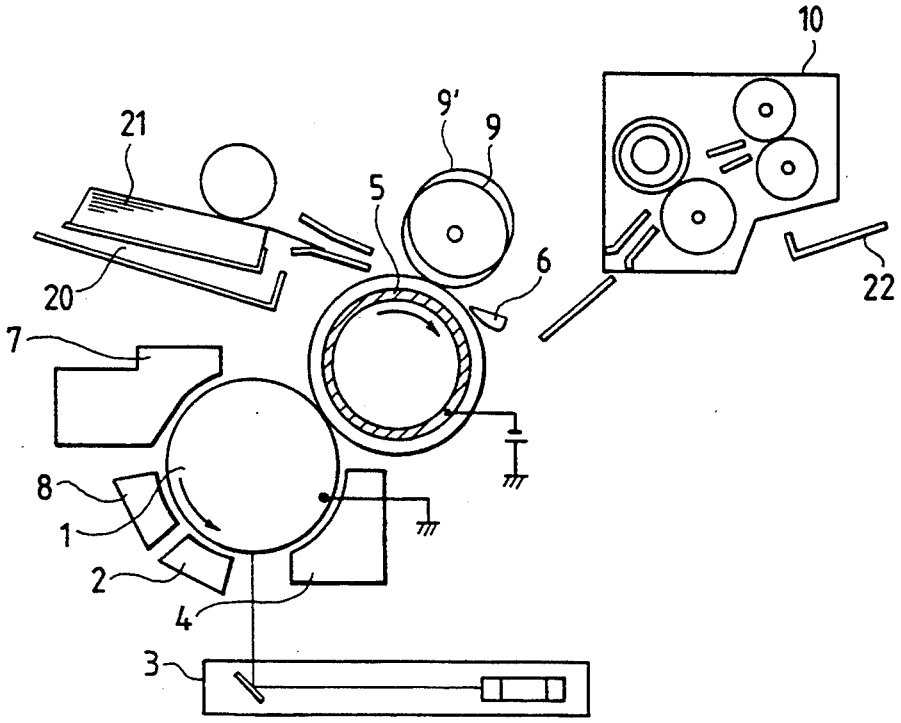
FIG. 2 is a sectional view of an electrophotographic printer including the apparatus of FIG. 1.

FIG. 2 illustrates a sectional view of an electrophotographic printer including a wet development apparatus according to a first embodiment of the invention. In the printer, a charger 2, an exposure unit 3, the wet development apparatus 4, a transfer drum 5, a cleaner 7, and an electrostatic discharge unit 8 are sequentially disposed around a photosensitive drum 1. The drum 1, which is an electrostatic latent image carrier, which is made of an aluminum sleeve 100 and a photosensitive layer 101 of amorphous selenium formed on the outer surface of the sleeve through evaporative deposition, is rotated in a direction A, as shown in FIG. 1.

The printer forms an image on recording paper in the manner described below.

A pressure roller is placed in a pressure non-application position 9' from the transfer drum 5. An electrostatic latent image is formed on the peripheral surface of the photosensitive drum 1 through a step of charging and a step of exposure. The electrostatic latent image is developed with a wet developer by the wet development apparatus 4. That is, a toner image is formed on the drum 1, and is then electrostatically transferred from the drum 1 to the peripheral surface of the transfer drum 5 as the drums are rotated. After the transfer, the peripheral surface of the photosensitive drum 1 is cleaned by the cleaner 7 and electrically neutralized by the electrostatic discharge unit 8. The next step then is to recharge the photosensitive drum by the charger 2.

The recording paper 21 (i.e., an image recording material) is conveyed out of a paper feeder 20 to the transfer drum 5 along with the formation of the toner image on the photosensitive drum 1. The pressure roller is then placed in a pressure application position 9 on the transfer drum 5 so that the toner image is transferred from the transfer drum to the recording paper 21. After the transfer, the recording paper 21 is separated from the transfer drum 5 by a separation claw 6. The carrier liquid of the wet developer on and/or in the paper 21 is then evaporated by a thermal fixation unit 10, while the toner image is fixed to the paper by the unit. The recording paper 21 is thereafter put into a tray 22.

The wet developer is composed of a carrier liquid, which is a high-resistivity petroleum solvent (such as Isopar produced by Esso Co., Ltd.), grains of a toner, which are a coloring agent made of a pigment and an acrylic resin, a charging control agent, and a dispersion stabilizing agent. The grains of the toner are dispersed together with the agents in the carrier liquid. The developer is positively charged to selectively cling to the exposed portion of the positively-charged peripheral surface of the photosensitive drum 1. The ratio of the carrier liquid to the developer is minimized so long as the conveyance of the developer is not degraded. In other words, the ratio of the toner to the developer or to the concentration of the solid of the developer is increased to an optimum level.

FIG. 1 shows the wet development apparatus 4 in which a developer application head 55 having a developer outflow slot 72 is provided in such a manner that the outlet portion 111 of the slot faces a development roller 103 made of an electroconductive elastic material. The roller 103 is rotated in a direction B at the same rotational speed of the photosensitive drum 1, which is in elastic contact therewith. The apparatus 4 has a development roller cleaning blade 110, which can be made of metal, resin, or rubber, disposed in such a manner that the tip thereof is in contact with the development roller 103.

The development of the electrostatic latent image by the wet development apparatus 4 is next described.

After the peripheral surface of the photosensitive drum 1 is uniformly and positively charged by the charger 2, the surface is subjected to exposure by the exposure unit 3 so that the exposed portion 105 of the surface has a first potential (e.g., 40 V), near ground potential, and the unexposed portion 104 of the surface has a second potential (e.g., 500 V). The charged peripheral surface of the drum 1 is then rotated along the wet development apparatus 4. A power supply 102-*a* keeps the development roller 103 at a positive potential (e.g., 250 V) lower than that of the unexposed portion 104. The upper portion 74 of the developer application head 55, which is made of an electroconductive material, is kept at a potential (e.g., 500 V) by a power supply 102-*b* higher than that of the development roller. An electric field is thus generated between the upper portion 74 and the development roller 103.

The wet developer 56, which has a high concentration of the solid, is driven out of the developer outflow slot 72 of the head 55 and uniformly applied to the peripheral surface of the development roller 103. The toner grains of the developer are positively charged so that the developer clings as a layer to the peripheral surface of the development roller 103 due to the way the developer is driven from the slot 72, the presence of the electric field, and the wetness of the developer which is minimized but still permits the toner to flow with the carrier liquid. The roller 103 and the drum, whose peripheral surfaces are in contact with each other, are rotated at the same circumferential velocity. Therefore, the layer 106 of the developer clinging to the roller 103 is put into elastic contact with the photosensitive drum 1. As the developer layer 106 contacts the drum, it receives electrostatic forces corresponding to the electrostatic latent image formed on the drum 1. One of the forces acts on the drum 1 at the exposed portion 105 of the peripheral surface thereof, while the other force acts on the roller 103 at the unexposed portion 104 of the surface. As a result, part of the developer layer 106 is moved to the exposed portion 105, and the remaining part of the layer is not moved to the unexposed portion 104, but remains on the roller 103, forming the toner image on the drum 1.

The concentration of the toner of the developer on the roller 103 is kept high to make the latent image visible but without feeding as much developer to the roller as in a conventional development apparatus. The developer layer remaining on the roller 103 is scraped off by the development roller cleaning blade 110, and then put into a developer recovery vessel 130. Since the developer fed to the development roller 103 has a consistent high concentration of toner, the shade of the image, which is determined by the toner through the development of the latent image, does not change with time.

The development roller cleaning member 110 may be constituted by a roller-shaped sponge member. Although this embodiment shows the development roller 103 in contact with the photosensitive drum 1, the present invention is not so limited but may otherwise be embodied so that rollers slightly larger in outside diameter than the development roller are provided thereon at both ends thereof, and located in contact with the drum to define a small clearance between the development roller and the drum. The small clearance therebetween is provided, so that it is possible to move the developed toner toward the downstream side of the contacting position between the development roller and the photosensitive drum. Thereby, the developer is never be stacked on the upstream side of the contacting position.

Figure 3:
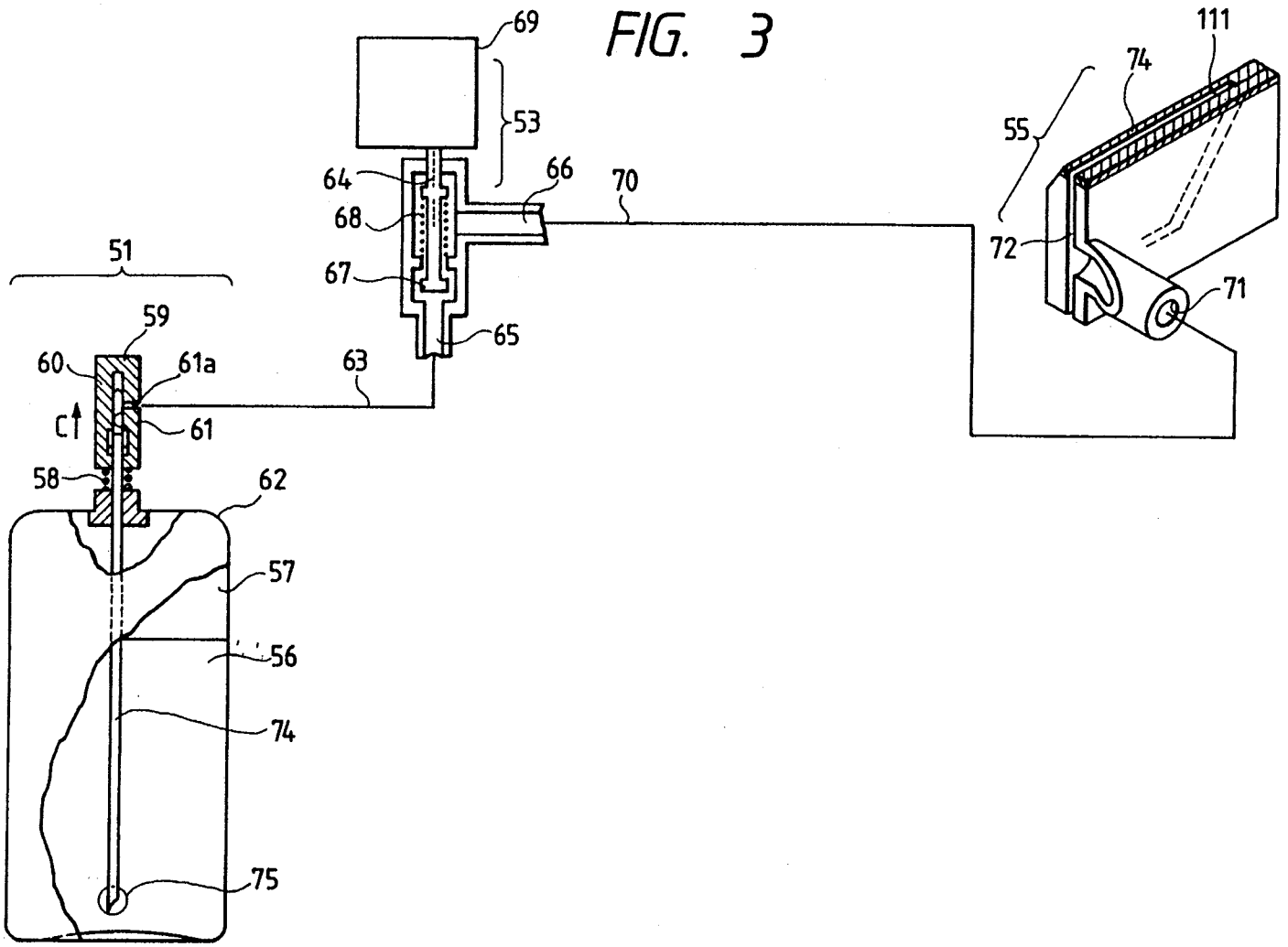
FIG. 3 depicts a system for feeding a developer to the developer application head of the apparatus of FIG. 1.

The feeding of the developer 56 to the developer application head 55 will now be described with reference to FIG. 3, which shows a system for feeding the developer to the head 55.

A developer storage vessel 51 is connected to the feed port 71 of the head 55 through a pipe 63, a regulator valve 53, and a pipe 70. The body 62 of the vessel 51 is filled with the developer 56 and a high-pressure inert gas 57, as described in Japan Unexamined Published Patent Application No. 64587/90. The vessel 51 has a pipe 74 open at one end 75 thereof, closed at the other end 60 thereof, and has a small hole 61 near the latter end. The vessel 51 also has a movable cap 59 which is slidable relative to the pipe and sealed so that the contents of the vessel do not leak through between the pipe and the cap. The cap 59 is urged in a direction C by a spring 58 so that when the cap is pushed against the force of the spring, a small hole 61*a* provided in the side portion of the cap communicates with the small hole 61 of the pipe 74 to allow the developer 56 to be pushed out of the body 62 of the vessel 51 due to the pressure therein. FIG. 3 shows the cap 59 in the state that the developer 56 is not fed from the vessel 51.

In the regulation valve 53, a movable spindle 64 is urged by a spring 68 to disconnect an inlet port 65 and an outlet port 66 from each other by the tip flange 67 of the spindle. When the spindle 64 is slid in the axial direction thereof against the force of the spring 68 by an electromagnetic unit 69, the tip flange 67 is opened, and the inlet and outlet ports 65 and 66 are connected to one another to allow the developer 56 to feed through the valve 53. The valve 53 is controlled to be opened or closed to feed an appropriate amount of wet developer 56 to the developer application 55.

The developer storage vessel 51 is preset in an open state such that the movable cap 59 is held down. When the regulation valve 53 is opened at the time of image formation, the high pressure in the body 62 causes the wet developer 56 to flow from the vessel 51 to the developer outflow slot 72 of the development head 55 through the valve and the pipes 63 and 70. As the wet developer flows out from the outlet port 111 of the slot, it is applied to the peripheral surface of the development roller 103.

Figure 4:
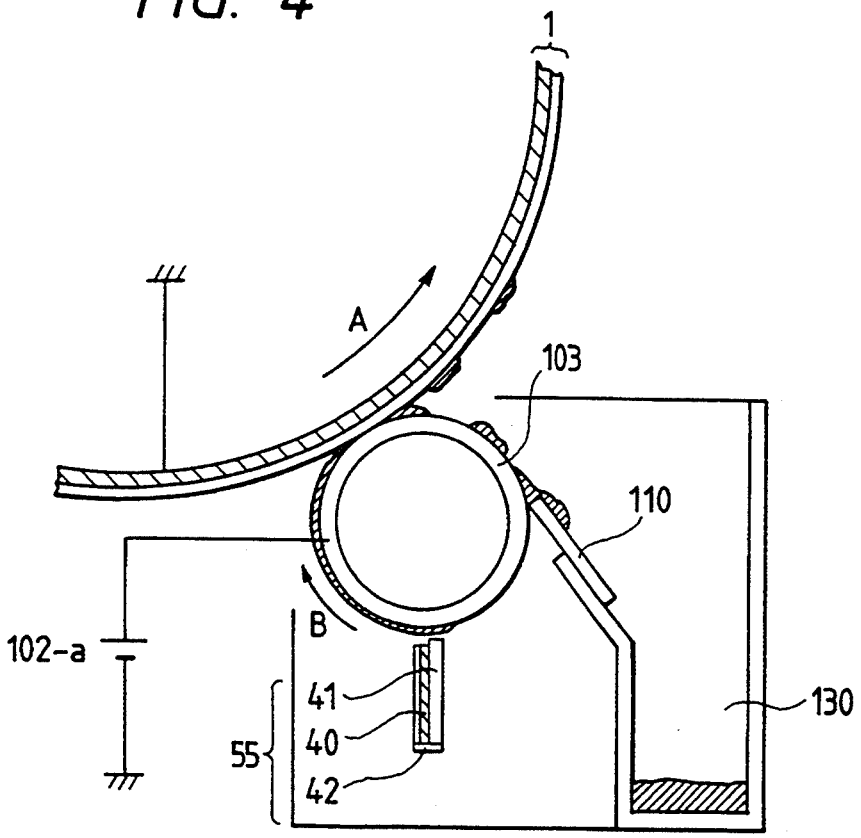
FIG. 4 is a structural view of a wet development apparatus according to another embodiment of the invention.

FIG. 4 shows a wet development apparatus according to another embodiment of the invention.

In contrast to the preceding embodiment wherein the developer is forced out of the slot of the developer application head through the action of the high-pressure inert gas in the developer storage vessel, this embodiment employs a developer which is forced out of a slot through the operation of a piezoelectric element. As shown in FIG. 4, a developer application head 55 includes a thin piezoelectric sheet 40 made of PZT, for example, having a thickness of about 60 $\mu$m, an opposite plate 41 facing the sheet across a minute gap of about 20 $\mu$m, and a bottom plate 42, which is sealed on one end of the sheet 40 and the opposite plate 41.

Figure 5:
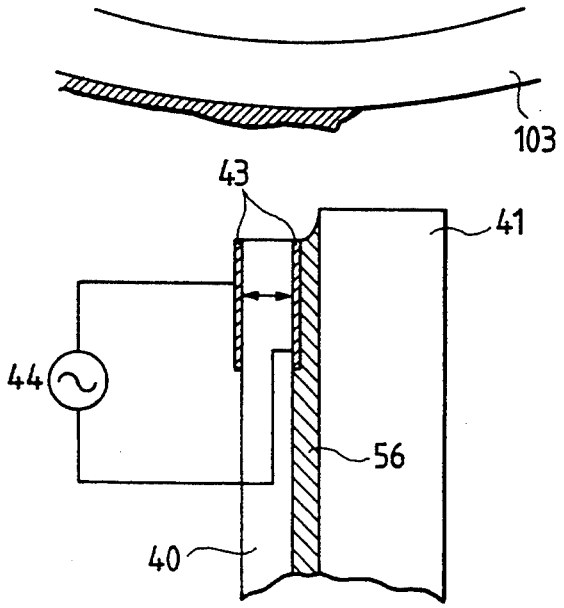
FIG. 5 is a sectional view of a major part of the developer application head of the apparatus shown in FIG. 4.

FIG. 5 is a sectional view of the apparatus in the vicinity of the outlet port of the gap between the sheet 40 and the opposite plate 41. Electrodes 43 are provided on both sides of the sheet 40 near the outlet port of the gap. When the developer 56 is fed to the vicinity of the bottom plate 42, the developer is lifted to the outlet port of the gap by a capillary force attraction. When an AC voltage of 60 V and 1.5 MHz is applied to the electrodes 43, the thin piezoelectric sheet 40 is vibrated. The vibration is transmitted to the developer 56 at the outlet port of the gap so that the developer is uniformly sprayed from the outlet port to the peripheral surface of a development roller 103. Depending on the width of the recording paper and the voltage applied to a selected pair of the electrodes, if a plurality of such electrodes are provided on each side of the sheet 40, the developer can be applied to the peripheral surface of the development roller 103 at a desired portion of the length of the surface. In all other respects, this embodiment is the same as the preceding embodiment.

Figure 6:
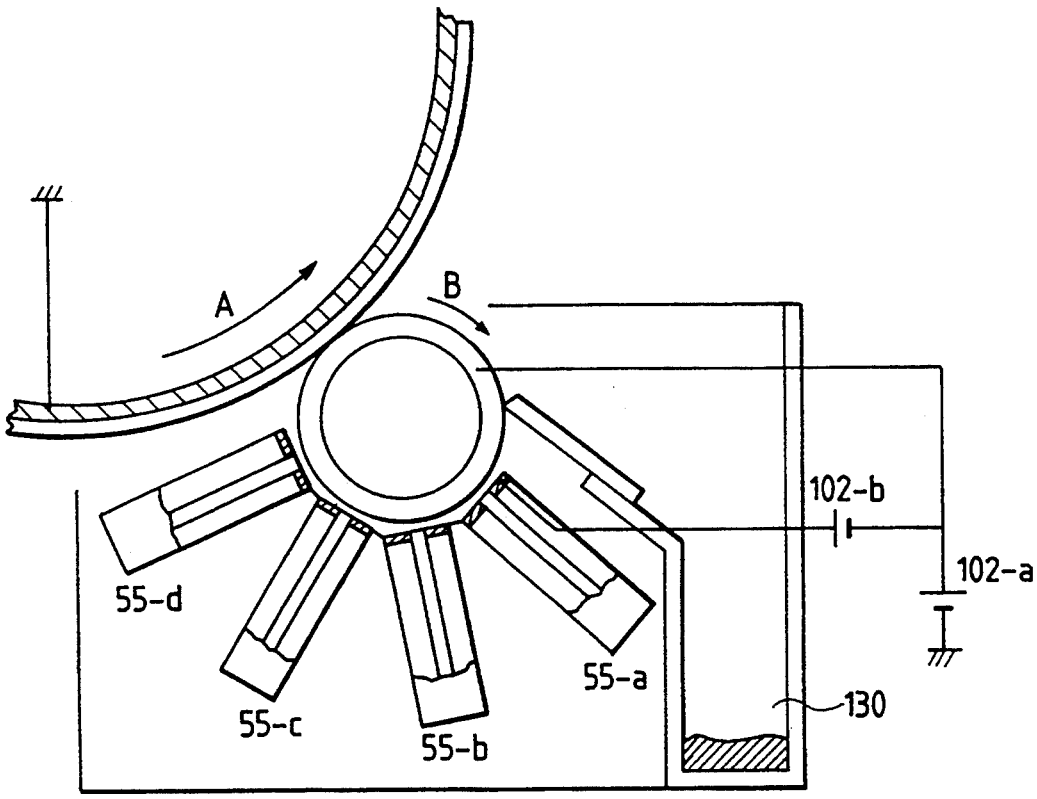
FIG. 6 is a structural view of a wet polychromatic development apparatus which is another embodiment of the invention.

FIG. 6 illustrates a wet polychromatic development apparatus which is constructed in accordance with yet another embodiment of the invention.

This embodiment differs from the preceding embodiment in that four developer application heads 55-*a*, 55-*b*, 55-*c*, and 55-*d*, from which four different color developers are supplied, are provided near a development roller 103. The colors of the developers are yellow, magenta, cyan and black. Toner images are made by combining the four developers to form a full-colored image.

More specifically, the developer of the first color is first selected and applied to the peripheral surface of the development roller 103 by the first developer application head 55-*a* so that a first electrostatic latent image is formed and then rendered visible on a photosensitive drum 1, and then transferred to an intermediate transfer drum 5 through an imaging operation similar to that in the preceding embodiment. A developer application head selection signal then selects the application head 55-*b* so that developer of a second color can be applied to the development roller 103. A second electrostatic latent image is rendered visible, and then is transferred to the intermediate transfer drum 5 to overlay the image of the first visible image. Other toner images of the third and the fourth colors are thereafter sequentially overlaid on the former images on the intermediate transfer drum 5 in the same manner as the second image so that the full-colored image is formed on the drum. The full-colored image is then transferred from the drum 5 to recording paper 21. In this embodiment, the different color developers are instantaneously changed without mixing colors with each other on the development roller 103, but by changing the developer application head selection signals. Importantly, it is not necessary to provide a "put-aside" mechanism for putting the member of the development apparatus aside.

Figure 7:
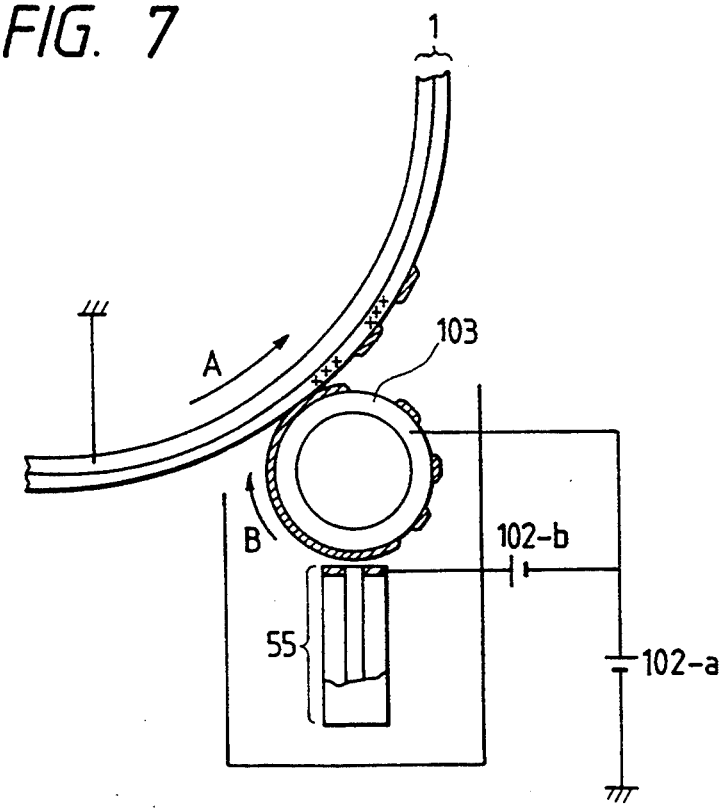
FIG. 7 is a structural view of a wet development apparatus according to another embodiment of the invention.

FIG. 7 shows a wet development apparatus which is constructed in accordance with yet another embodiment of the invention.

This embodiment differs from the preceding embodiment in that a development roller cleaning blade is not provided. In this embodiment, any developer remaining on the peripheral surface of the development roller 103 after its surface has come into contact with the photosensitive drum 1 is used again for development. The manner in which the developer clings to the peripheral surface of the development roller 103 after contacting the surface of the drum 1 depends on the pattern of an electrostatic latent image thereon. Since the developer is driven out of a developer application head 55 under high pressure, the developer is uniformly applied to the peripheral surface of the development roller 103. When the electrostatic latent image is made visible due to the development thereof, the developer is no longer discharged from the head 55. Since the remaining developer is not removed from the development roller 103 by the development roller cleaning blade, the developer is more efficiently used in the apparatus of the FIG. 7 embodiment than in that shown in FIGS. 1 and 2.

Figure 8:
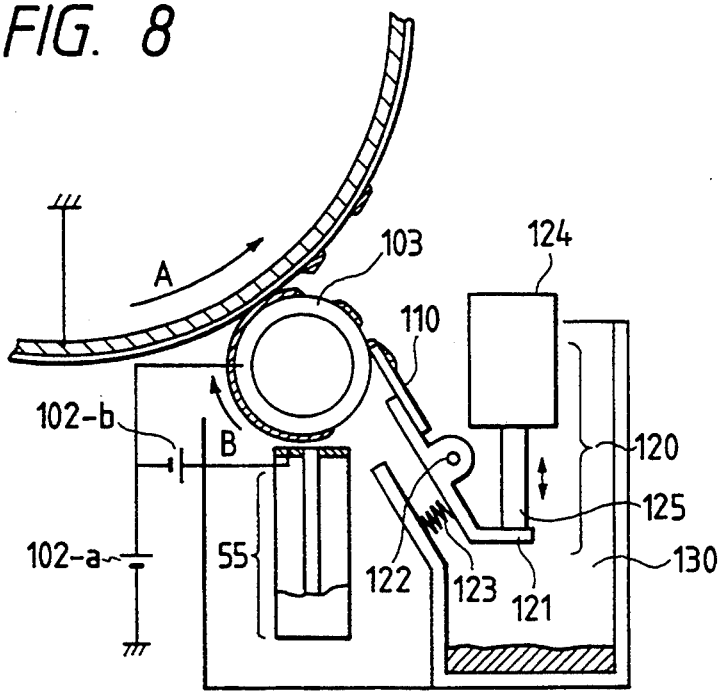
FIG. 8 is a structural view of a wet development apparatus which is in accordance with yet another embodiment of the invention.

FIG. 8 shows another embodiment of a wet development apparatus.

The FIG. 8 embodiment differs from that shown in FIG. 1 in that it has a contact/no-contact mechanism 120 for putting the development roller cleaning blade 110 into and out of contact with the development roller 103. The blade 110 is supported by a blade support plate 121 in a turnable manner with a support shaft 122 secured to a developer recovery vessel 130. The position of the blade support plate is determined by a push spring 123 and the moving portion 125 on an electromagnetic unit 124. When the moving portion 125 is protruded, the blade 110 is put out of contact with the roller. When the moving portion 125 is retracted, the blade 110 is placed in contact with the roller 103. In all other respects, the FIG. 8 embodiment is the same as that shown in FIG. 1.

When an electrostatic latent image is being developed by transferring the developer from the development roller 103 to a photosensitive drum, the development roller cleaning blade 110 is put out of contact with the roller and the contact/no-contact mechanism so that any developer remaining on the peripheral surface of the roller can be used again. When the development of the latent image is completed, the developer is no longer supplied from the developer application head 55, and the blade 110 is placed into contact with the roller 103 by the mechanism so that any remaining developer still remaining on the roller is scraped off by the blade into the developer recovery vessel 130.

A wet polychromatic development apparatus similar to that shown in FIG. 6 can be provided as a modification to the apparatus shown in FIG. 8. In the wet polychromatic development apparatus, four developer application heads for four different color developers are provided. A development roller cleaning blade is placed in contact with the peripheral surface of a development roller every time the developers are changed and after an electrostatic latent image is developed.

Figure 11:
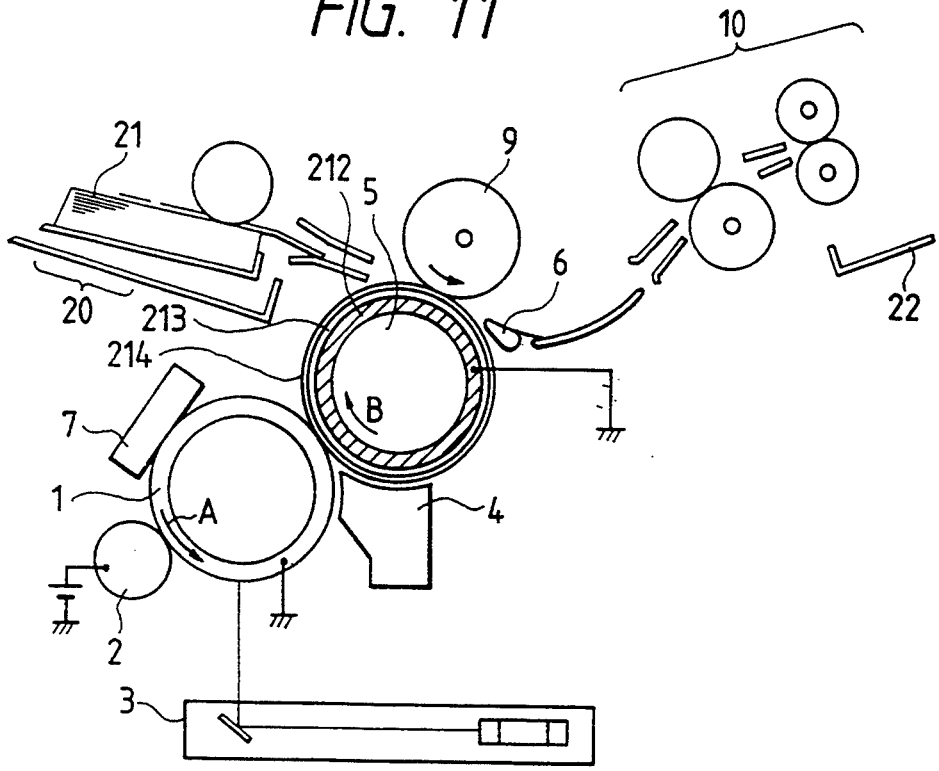
FIG. 11 is a sectional view of the apparatus of FIG. 9.

FIG. 11 illustrates an sectional view of a second embodiment of a electrophotographic printer, which includes a wet development apparatus 4 in accordance with the invention.

Figure 9:
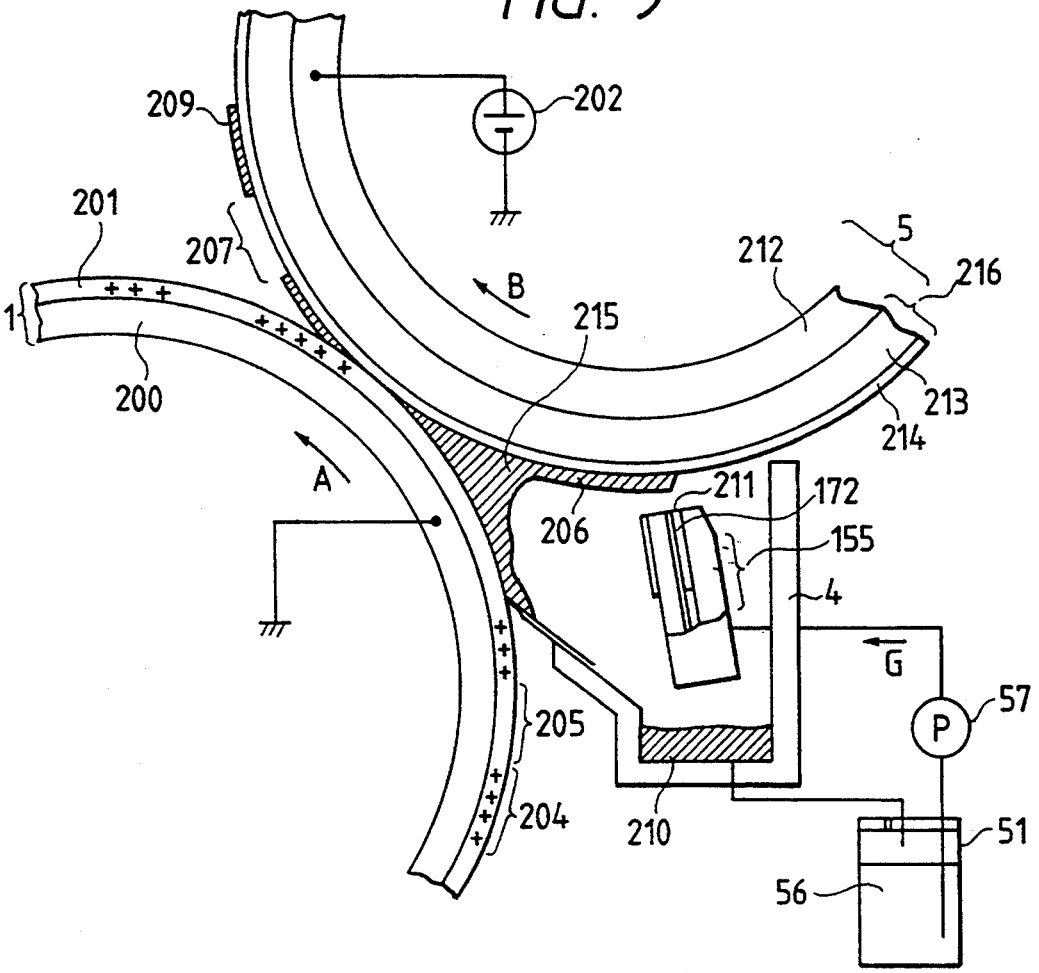
FIG. 9 is a sectional view of a wet development apparatus included in a wet recording machine according to another embodiment of the invention.

The printer includes a charger 2, an exposure unit 3, the wet development apparatus 4, an elastic drum 5, a cleaner 7, all of which are sequentially disposed around a photosensitive drum 1, and a separation claw 6 near the elastic drum 5. The photosensitive drum 1, which is an electrostatic latent image carrier, is made of an aluminum sleeve 200 and a photosensitive layer 201 of amorphous selenium evaporatively deposited on the peripheral surface of the tube, as shown in FIG. 9. The photosensitive drum 1 is rotated in a direction A.

The wet development apparatus 4 will now be described with reference to FIG. 9.

In the apparatus 4, a development head 155, which is a wet developer application device, has a development slot 172 arranged such that an outlet portion 211 of the slot faces the peripheral surface of the elastic drum 5. The drum 5 is made of a metal sleeve 212 with an elastic layer 216 provided on the peripheral surface thereof. The elastic layer 216 is composed of an electroconductive layer 213 of an electroconductive urethane rubber containing an electroconductive compound dispersed in the rubber, and an electrically insulating layer 214, which is the outermost layer of the drum, made of a fluorine resin. The drum 5 is disposed in pressure contact with the photosensitive drum 1, and rotated in a direction B at the same speed as the drum 1. A wet developer 56 is fed from a developer storage vessel 51 to the development slot 72 of the development head 155 by a feed pump, as shown by an arrow G in FIG. 10, so as to fill the slot developer.

Figure 10:
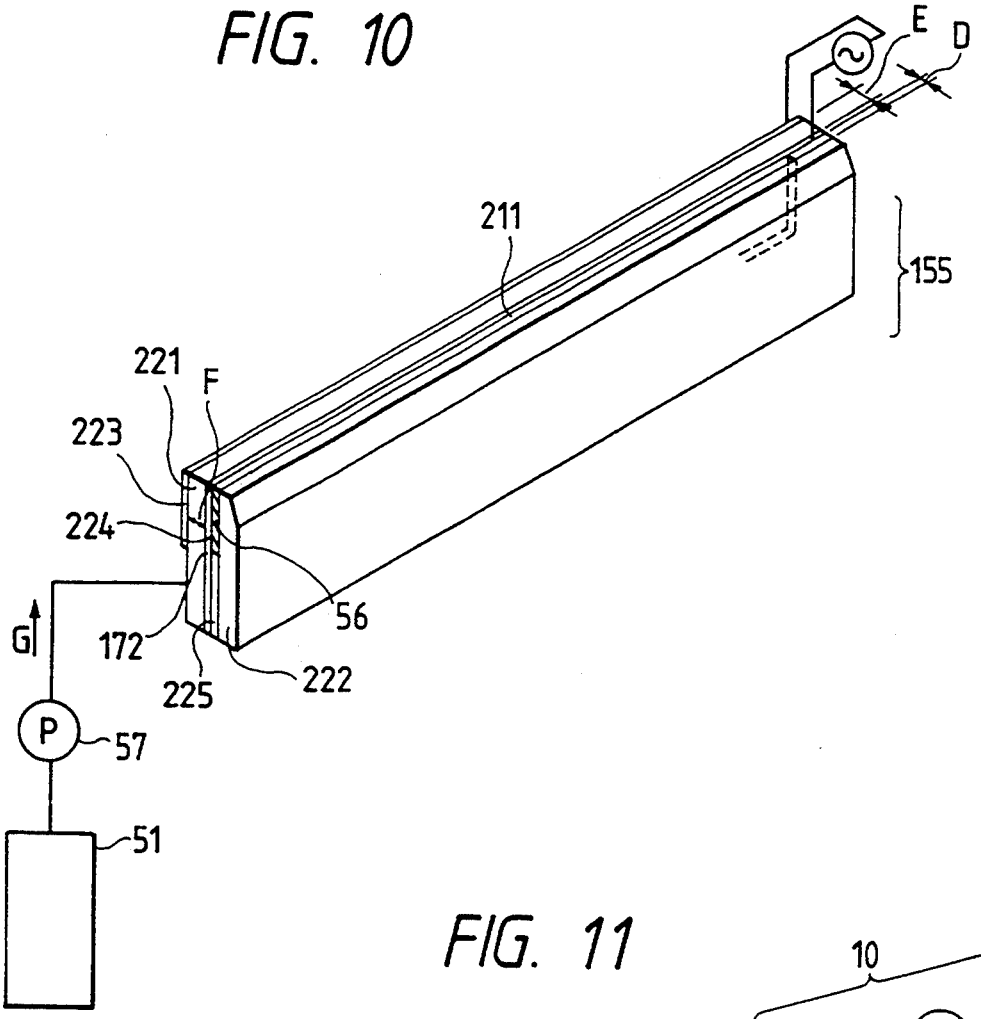
FIG. 10 is a perspective view of the development head of the apparatus of FIG. 9.

The development head 155 includes a metal plate 222, a spacer 225, and a piezoelectric ceramic plate 221 which are juxtaposed together as shown in FIG. 10. Electrodes 223 and 224 are provided on both sides of the ceramic plate 221. The wet developer 56, which is fed to the slot 172, is retained therein by a capillary attraction force.

The wet developer 56 is composed of a high-resistivity petroleum solvent (such as Isopar produced by Esso Co., Ltd.), grains of a toner made of a pigment and an acrylic resin, a charging control agent, and a dispersion stabilizing agent, as disclosed in U.S. Pat. No. 3,900,612. The grains of the toner are dispersed together with the agents in the solvent, which acts as the carrier liquid of the developer. The grains of the toner are positively charged.

The imaging operation of the electrophotographic printer will now be described.

The charger 2 applies a high voltage to an electroconductive rubber roller which is placed into contact with the photosensitive drum 1 to positively charge it. The peripheral surface of the photosensitive drum 1 is then selectively exposed to light by the exposure unit 3 so that the charge of the exposed portion of the surface is neutralized. As a result, an electrostatic latent image is formed on the peripheral surface of the drum 1.

A toner image, which corresponds to the electrostatic latent image on the photosensitive drum 1, is formed on the elastic drum 5, as described in detail hereinafter.

Recording paper 21 is conveyed from a paper feeder 20 to the transfer section of the printer along with the formation of the toner image. The paper 21 is placed into pressure contact with the peripheral surface of the elastic drum 5 by a pressure roller 9 so that the toner image is transferred from the drum to the paper. The paper 21 is thereafter separated from the elastic drum 5 by the separation claw 6, and put into a paper tray 22 by a paper move-out unit 10. After the transfer, the peripheral surface of the photosensitive drum 1 is cleaned by the cleaner 7, and a separating agent is applied to the surface before the surface is positively charged again by the charger 2.

The developing operation of the wet development apparatus 4 is next described.

The peripheral surface of the photosensitive drum 1 is positively and uniformly charged to a first potential (e.g., 500 V) when the peripheral surface of the drum 1 is exposed to light by the exposure unit 3, the exposed portion 205 of the peripheral surface of the drum has a potential near ground (e.g., 40 V), and the unexposed portion 204 of the surface has a potential of about 500 V. The peripheral surface of the drum 1 is then rotated along the wet development apparatus 4. The wet developer is driven out from the development slot 172 of the development head 155 in the form of drops and applied to the peripheral surface of the elastic drum 5 so that the charged grains of the toner of the developer form a layer clinging to the peripheral surface while being wetted with a small quantity of the carrier liquid of the developer. A power supply 202 keeps the peripheral surface of the elastic drum 5 at a potential of about 50 V, which is lower than that of the unexposed portion 204. Since the layer 206 of the wet developer on the peripheral surface of the elastic drum 5 has a positive charge, the layer receives an electrostatic force acting in the direction of the photosensitive drum 1 at the exposed portion 205, and an electrostatic force acting in the direction of the elastic drum at the unexposed portion 204 as the layer is placed in contact with the peripheral surface of the photosensitive drum. As a result, the developer continues to cling as a layer 209 to the portion of the peripheral surface of the elastic drum 5 which corresponds to the unexposed portion 204.

Although the electrostatic force causes the developer to cling to the peripheral surface of the photosensitive drum 1 at the exposed portion 205 which corresponds to the other portion 207 of the peripheral surface of the elastic drum 5, the developer is separated from both the elastic drum and the photosensitive drum for two reasons. First, the developer receives a sneezing action due to the mutual contacting portions of both drums and, second, the electrostatic attractive force between the developer and the photosensitive drum is not strong enough due to the relationship between the above-mentioned potentials. The carrier liquid of the developer also receives a squeezing action, so that the liquid is prevented from moving downstream from the mutual contact portions of the drums 1 and 5. The separated developer and the carrier liquid prevented from moving downstream from the mutual contact portions of the drums 1 and 5 remain in a holding place 215 upstream of the mutual contact portions of the drums. The developer separated from both drums 1 and 5 remains in the holding place 215 where the drums come into contact with each other. The quantity of the developer in the holding place 215 increases with the lapse of time until it exceeds a predetermined value, in which case the developer then seeps into the lower portion 210 of the wet development apparatus 4 due to gravity. The developer in the lower portion 210 is then recovered in the developer storage vessel 51.

The inventors conducted an experiment in which a wet developer of 10% to 30% in solid concentration calculated as ((weight of wet developer)-(weight of carrier liquid))/(weight of wet developer) was uniformly applied at a thickness of about 100 μm to the peripheral surface of the elastic drum 5, forming a developer layer 206 thereon. The layer was placed in contact with the peripheral surface of the photosensitive drum to form a wet developer layer 209 of about 5 μm in thickness. Because the carrier liquid of the developer did not remain on the non-image portions of the peripheral surfaces of the drums 1 and 5, a squeeze mechanism is not needed, and a toner image with no background fog was obtained. The toner image was then transferred to the recording paper 21 with a thickness of about 2 μm on the paper 21.

In the development head 155, the piezoelectric ceramic plate 221 and the metal plate 222 face each other across a small clearance D, as shown in FIG. 10. When a high-frequency (approximately 1.8 MHz) voltage is applied to the electrodes 223 and 224, which are provided on both sides of the piezoelectric ceramic plate 221, the plate is compressed and expanded in directions F. The ceramic plate 221 is made of PZT and has a thickness E of 1 mm. The wet developer 56 is fed into the clearance D of 20 μm. The plate 221 is thus vibrated in the directions F to spray the wet developer 56 in the form of minute drops from the clearance D. The wet developer 56 is fed from the developer storage vessel 51 to the development head 155 by a pump 57 filling the development slot 172 of the head with developer. The developer 56 is continuously fed to the head 55 during the printing operation of the printer.

Figure 13:
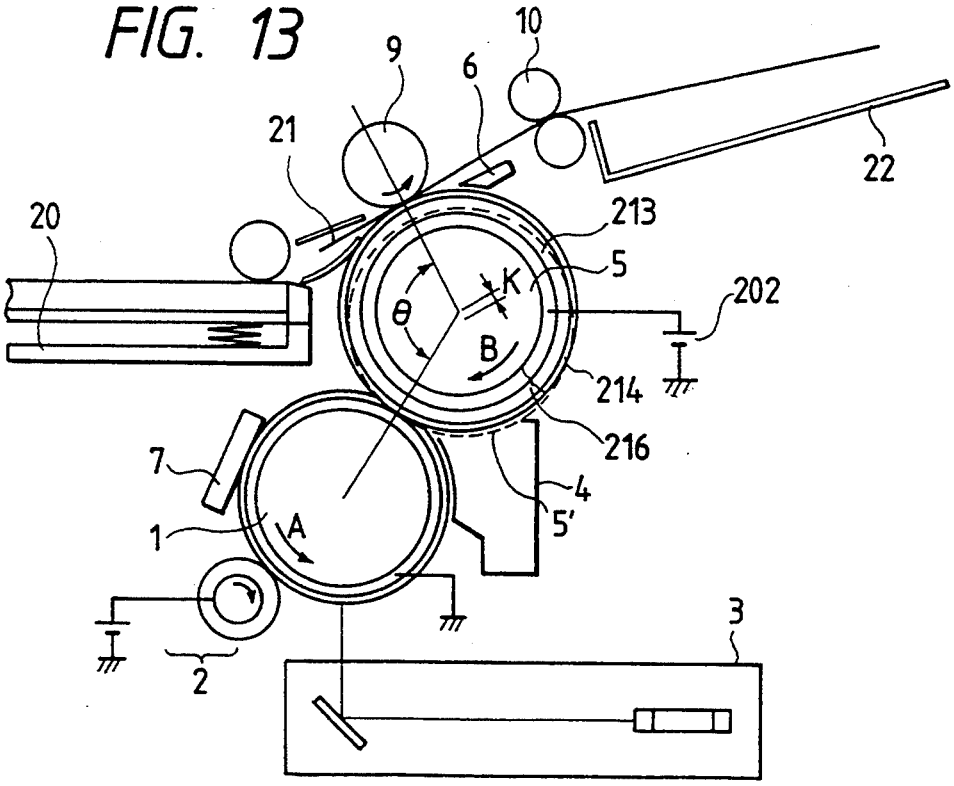
FIG. 13 is a sectional view of the machine according to a further embodiment of the invention.

FIG. 13 shows the other embodiment of the present invention. The angle $\theta$ between an imaginary straight line connecting the centers of the electrostatic image carrier 1 and the elastic drum 5 and another imaginary straight line connecting the 6enters of the drum and the pressure roller 9 is 120 degrees. A predetermined amount of pressure is applied to the carrier 1 and the drum 5 to place them in contact with each other to develop properly the electrostatic latent image. It is also necessary to uniformly apply pressure to the carrier 1 and the drum 5 along their mutually contacting portions. Sufficient pressure must be applied to the drum 5 and the roller 9 to place them in contact with each other to transfer the toner image from the drum to the recording paper 21. Since the pressure is relatively large in magnitude, the pressure applied to the elastic drum and the roller 9 to place them in contact with each other is likely to change depending on whether the recording paper 21 is present between them or not. In order to prevent the change from exerting an influence to alter the state of contact of the drums 1 and 5, the angle $\theta$ is set at 120 degrees, not at 180 degrees. The most desirable value of the angle $\theta$ for reducing the influence is 90 degrees at which the influence on the development of the image in the case that the elastic drum 5 is deformed due to the pressure of the roller 9 thereon is mostly reduced. In this embodiment, however, the angle $\theta$ is set at 120 degrees from a standpoint of providing an adequate installation space for the paper feeder 20. When the elastic drum 5 is partly displaced by a length of K due to the pressure of the roller 9 thereon as shown by a dotted line 5' in FIG. 13, the change in the distance between the centers of the photosensitive drum 1 and the elastic drum, which most affects the imaging property of the printer, is expressed as $-K.\cos(120°)$, which is half that in the case that the centers of the drums and the roller are located on an imaginary straight line.

Figure 12:
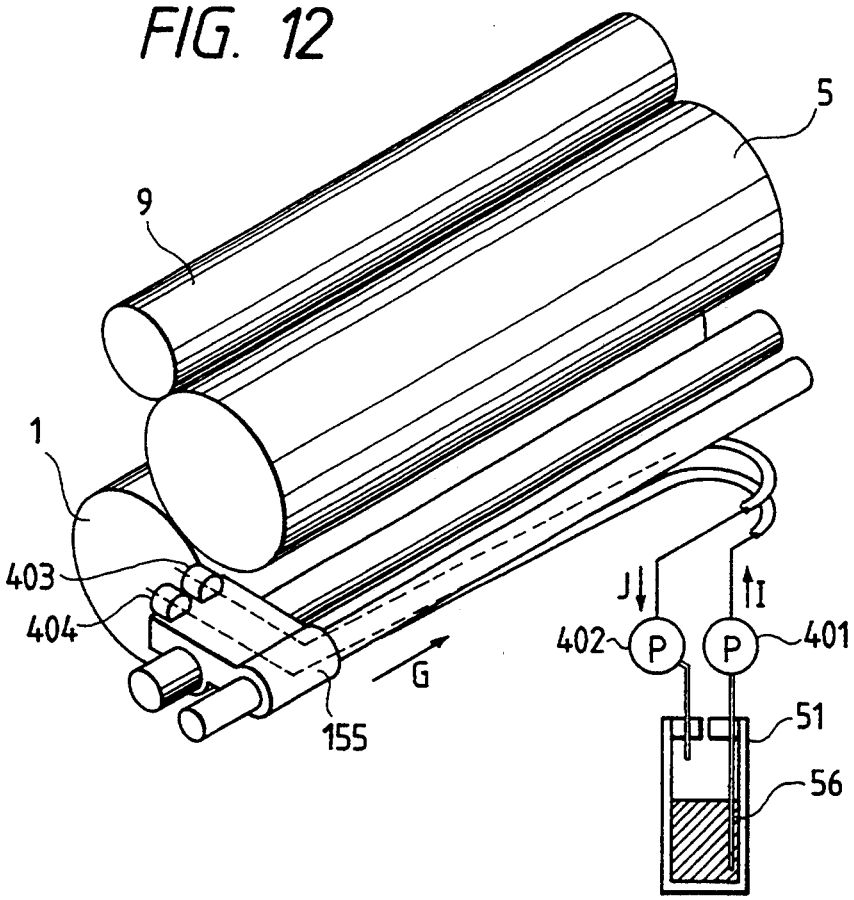
FIG. 12 is a perspective view of a wet development apparatus included in a wet printing machine which is accordance with another embodiment of the invention.

FIG. 12 shows the photosensitive drum 1, elastic drum 5, development head 155, and associated members of the wet development apparatus of electrophotographic printer. The wet development apparatus is identical to the preceding embodiment except for the drums 1 and 5, the head 155, and the associated members. The development head 155 delivers a wet developer 56 to where both the drums 1 and 5 come into contact with one another. A developer storage vessel 51 containing the wet developer 56 is connected to the development head 155. The developer 56 is pumped from the development storage vessel 51 by a drive-out pump 401, as shown by an arrow I in FIG. 12, to the drive-out portion 404 of the head 155 where it is discharged. Developer collecting where the drums 1 and 5 come into contact with each other is sucked through the suction portion 403 of the head 155 by a suction pump 402 and conveyed back into the vessel 51, as shown by an arrow J in FIG. 12. The head 155 moves in a scanning direction G to deliver the developer 56 to all points of mutual contact of the drums 1 and 5. A predetermined amount of the developer 56 is thus fed to where the drums 1 and 5 come into contact with each other.

In the wet development apparatus described above, it is not necessary to provide a Cleaning device in pressure contact with the peripheral surface of the photosensitive drum 1 in order to remove any remaining toner therefrom. In addition, since the photosensitive drum 1 does not come into contact with the recording paper, wear of the drum is reduced, thus lengthening the life thereof. Since the toner image on the elastic drum 5 does not have much of the carrier liquid of the developer, the quantity of the carrier liquid transferred to the recording paper is so small that it is not necessary to heat the paper to evaporate the liquid. For this reason, a thermal fixation unit or the like is not needed, thus lessening the consumption of electric power.

In the above wet recording machine, a wet developer is sprayed in the form of minute drops from a development head so that the developer is applied to an electrostatic latent image carrier. An intense electric field acts on the developer at the place of the mutual contact of the carrier and an elastic drum depending on an electrostatic latent image on the carrier as the developer on the drum comes into contact with the carrier. For this reason, the latent image can be developed with a developer having a high concentration of the solid. In other words, the viscosity of the developer does not need to be kept as low as in the conventional case in which charged grains of a toner are electrophoretically moved in a carrier liquid so as to cling to an electrostatic latent image carrier. It is thus made possible to decrease the quantity of the developer necessary for the formation of the developed image, and to increase the viscosity of the developer.

Since the carrier liquid of the developer does not cling to the non-image portions of the peripheral surfaces of the carrier and the drum, the wet printing machine does not need a squeeze mechanism as in conventional wet printing machines. Since the magnitude of an electric field for development depends on the size of the clearance between a development electrode facing an electrostatic latent image carrier in the conventional wet printing machine, it is necessary to accurately maintain the size of the clearance. However, since the electrostatic latent image carrier and the elastic drum are put in pressure contact with each other in the machine provided in accordance with the present invention, it is not necessary to maintain a small clearance between the carrier and the drum. For this reason, the machine is simplified.

Since not all of the centers of the electrostatic latent image carrier, the elastic drum, and a pressure roller are located along straight line, their effect on the quality of a toner image is reduced. This also serves to simplify the wet recording machine.

When a toner image on the photosensitive drum of the conventional wet recording machine is transferred to a rough recording paper, the quality of the image is likely to deteriorate, and it is therefore difficult to properly transfer the toner image to the paper. However, since a toner image is formed on the elastic drum, the wet recording machine and the roller come into good tight contact with the recording paper, and therefore the quality of the toner image transferred to the recording paper is improved. Since the toner image is directly formed on the elastic drum, the toner image does not need to be transferred a plurality of times. This also serves to simplify the machine.

Although the toner image formed on the electrostatic latent image carrier of the conventional wet recording machine through development needs to retain prescribed electrostatic properties in preparation for the transfer of the toner image, that formed on the electrostatic latent image carrier of the wet recording machine provided in accordance with the present invention through the development process does not need to retain such electrostatic properties on the carrier because the toner image is mechanically transferred to the recording paper. In addition, the viscosity of the wet developer can be made high. Therefore, the choice of the composition of the wet developer is wide, and it is easy to prepare the developer.

As for the conventional wet recording machine which electrostatically transfers the toner image, the image is accompanied by a larger quantity of the carrier liquid of the developer in the machine. As for the wet recording machine provided in accordance with the present invention, the toner image on the elastic drum is accompanied by a smaller quantity of the carrier-liquid of the developer. For this reason, in the latter machine, the amount of the developer can be reduced, and the recording paper having the toner image transferred thereto can be dried in a shorter time.

Figure 14:
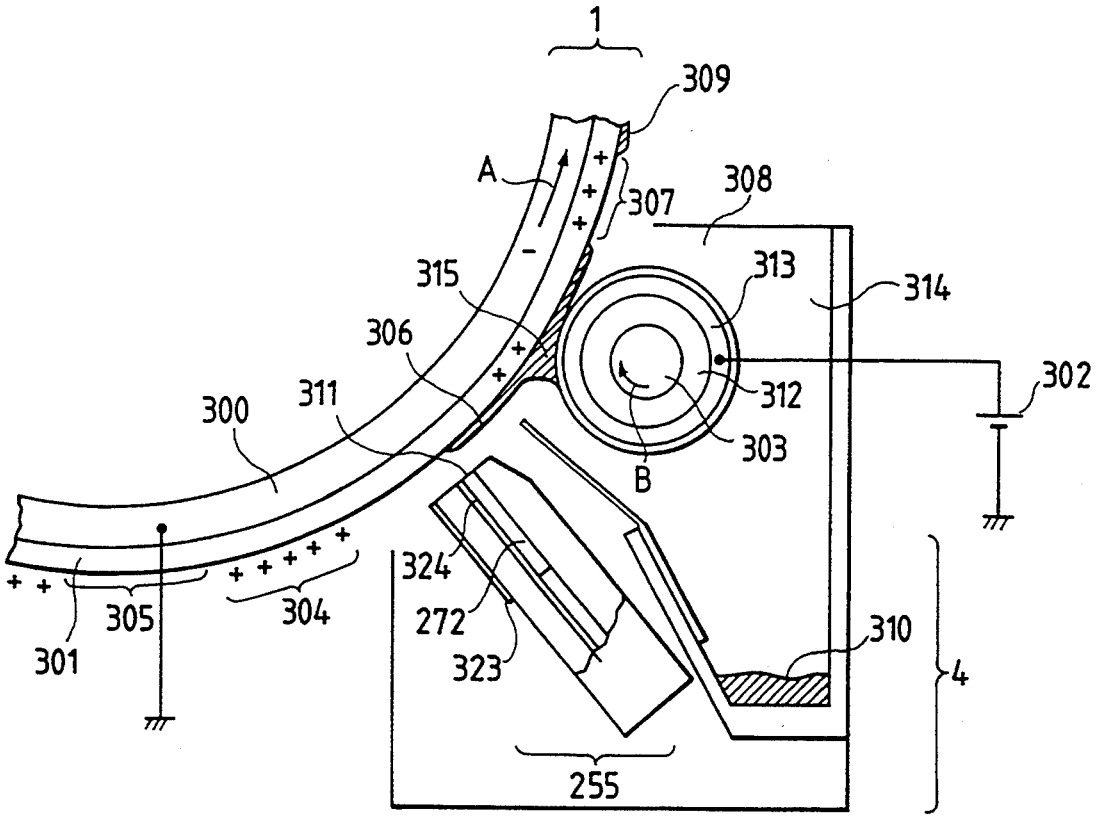
FIG. 14 is a sectional view of a wet development apparatus according to still yet another embodiment of the invention.
Figure 16:
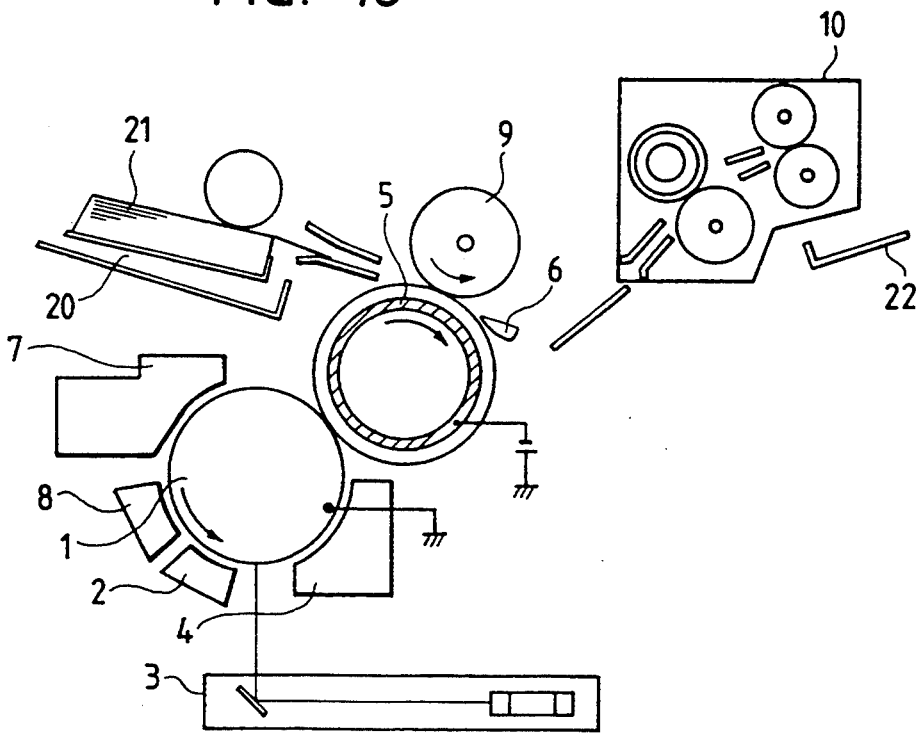
FIG. 16 is a sectional view of an electrophotographic printer including the apparatus of FIG. 14.

FIG. 16 illustrates a sectional view of a third electrophotographic printer which includes a wet development apparatus 4, a charger 2, an exposure unit 3, a transfer drum 5, a cleaner 7 and an electrostatic discharge unit 8, which are sequentially disposed around a photosensitive drum 1. The drum 5 is made of a metal tube and an electroconductive elastic layer provided on the tube. The photosensitive drum 1 is made of an aluminum tube 300 and a photosensitive layer 301 of amorphous selenium evaporatively deposited on the peripheral surface of the tube, and is rotated in a direction A, as shown in FIG. 14.

The wet development apparatus 4 will now be described with reference to FIG. 14. The apparatus 4 includes a developer application head 255 having a developer outflow slot 272 which is arranged in such a manner that the outlet port 311 of the slot is oriented toward the peripheral surface of the photosensitive drum 1. A development roller 303 is provided in the apparatus 4 in such a manner that the roller is in pressure contact with the photosensitive drum 1 and is rotated in a direction B at the same speed as the drum. The roller 303 is made of a metal sleeve 312, an elastic electroconductive layer 313 of an electroconductive urethane rubber containing an electroconductive compound, and an electrically insulating layer 314 which is a coating layer of a fluorine resin and is the outermost layer of the roller.

The application head 255 is made of a metal plate 322, a spacer 325, an electrode 324, a piezoelectric ceramic plate 321 and another electrode 323 which are juxtaposed together in such a manner that the developer outflow slot 272 is defined between the metal plate and the former electrode. The wet developer 320 is retained in the slot 272 by a capillary force. A part of the slot 272 is a detection slot 330 whose width is larger than that of the other part of the slot 272. When a high-frequency voltage is applied to the electrodes 323 and 324, the piezoelectric ceramic plate 321 is compressed and expanded in directions F.

The imaging operation of the electrophotographic printer is next described. An electrostatic latent image is formed on the peripheral surface of the photosensitive drum 1 through a step of charging and a step of exposure to light, and developed with the wet developer so that a toner image is formed on the drum. The toner image is electrostatically transferred from the drum 1 to the transfer drum 5. The peripheral surface of the photosensitive drum 1 is thereafter turned along the cleaner 7 and the electrostatic discharge unit 8 and again subjected to charging. Recording paper 21 is conveyed from a paper feeder 20 to the transfer drum 5 along with the formation of the toner image, and put into pressure contact with the transfer drum by a pressure roller 9 so that the toner image is transferred from the drum to the recording paper. After the paper 21 is separated from the transfer drum 5 by the separation claw 6, a thermal fixation unit 10 evaporates the carrier liquid on and/or in the paper and fixes the toner image thereto. The paper is then put into a paper tray 22.

In the developing operation of the wet development apparatus 4, the peripheral surface of the photosensitive drum 1 is positively and uniformly charged to have a potential of about 500 V. When the peripheral surface of the drum 1 is exposed to light, the exposed portion 305 of the surface has a potential of about 40 V (near ground potential), and the unexposed portion 304 of the surface has a positive potential of about 500 V. The peripheral surface of the drum 1 is thereafter rotated along the development apparatus 4. The wet developer 306 is sprayed out of the developer outflow slot 272 of the developer application head 255 so that the developer is applied to the peripheral surface of the drum 1. Thus, the charged grains of the toner cling as a layer to the peripheral surface of the drum 1 while remaining wet with a small quantity of the carrier liquid. A power supply 302 keeps the peripheral surface of the development roller 303 at a positive potential of about 450 V, which is lower than that of the unexposed portion 304. Since the layer of the wet developer on the peripheral surface of the drum 1 is positively charged, the layer receives an electrostatic force acting in the direction of the drum at the exposed portion 305 of the peripheral surface thereof and an electrostatic force acting in the direction of the development roller 303 at the unexposed portion 304 of the surface as the layer is placed into contact with the roller. As a result, a layer 309 of the developer clings to the exposed portion 305. Although the developer on the unexposed portion 304 or 307 receives the electrostatic force which acts in such a direction as to separate the developer from the drum 1, the developer is removed from the roller 303 due to the pressure of the contact of the developer and the drum 1 and remains in a retaining place 315 upstream of the place of the contact because the attractive force between the developer and the drum is not strong enough due to the relationship between the above-mentioned potentials. The quantity of the developer remaining in the retaining place 315 increases with the lapse of time. When the quantity has reached a certain level, the developer gravitates so that it is recovered into the lower portion of the development apparatus 4.

The inventors conducted an experiment in which a wet developer of 10% to 30% in solid concentration calculated as ((weight of wet developer)-(weight of carrier liquid))/(weight of wet developer) was uniformly applied to the peripheral surface of the photosensitive drum 1 so as to form a developer layer of about 20 μm in thickness thereon, the layer was placed in contact with the peripheral surface of the development roller 303 so as to form a wet developer layer of about 5 μm in thickness on the peripheral surface of the photosensitive drum after the contact, and the latter layer was transferred to the recording paper and fixed thereto so as to form a toner image of about 2 μm in thickness thereon.

Figure 15:
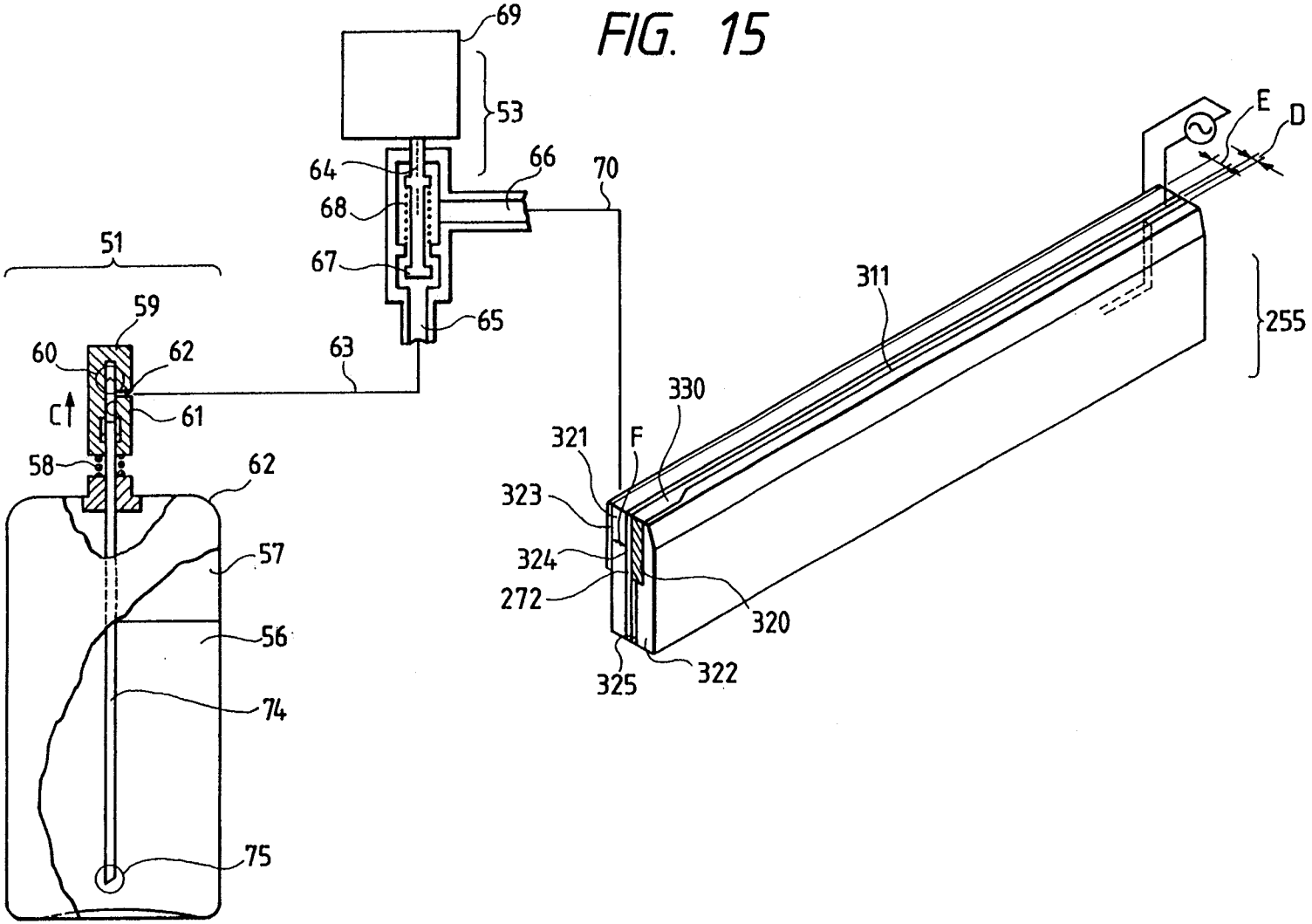
FIG. 15 is a view of the wet developer feed system of the apparatus of FIG. 14.

With reference to FIG. 15, the piezoelectric ceramic plate 321 and the metal plate 322 face each other across a small clearance D of 20 μm. A high-frequency voltage is applied to the electrodes 323 and 324 provided on both the sides of the ceramic plate 321. The ceramic plate 321 is made of PZT and has a thickness E of 1 mm. The wet developer 320 is fed into the clearance D. The piezoelectric ceramic plate 321 is vibrated at a frequency of 1.8 MHz in the directions F so that the wet developer 320 is sprayed from the slot 272 of the head 255.

The developer storage vessel 51 is preset to an open state such that the moving cap 59 is pushed down. To form the toner image, the regulator valve 53 is opened so that the wet developer 56 is filled into the slot 272 of the developer application head 255 through the pipe 63, the valve and the pipe 70 because of the high pressure in the body 62 of the vessel 51.

The regulator valve 53 is controlled in a manner as will now be described.

Figure 17:
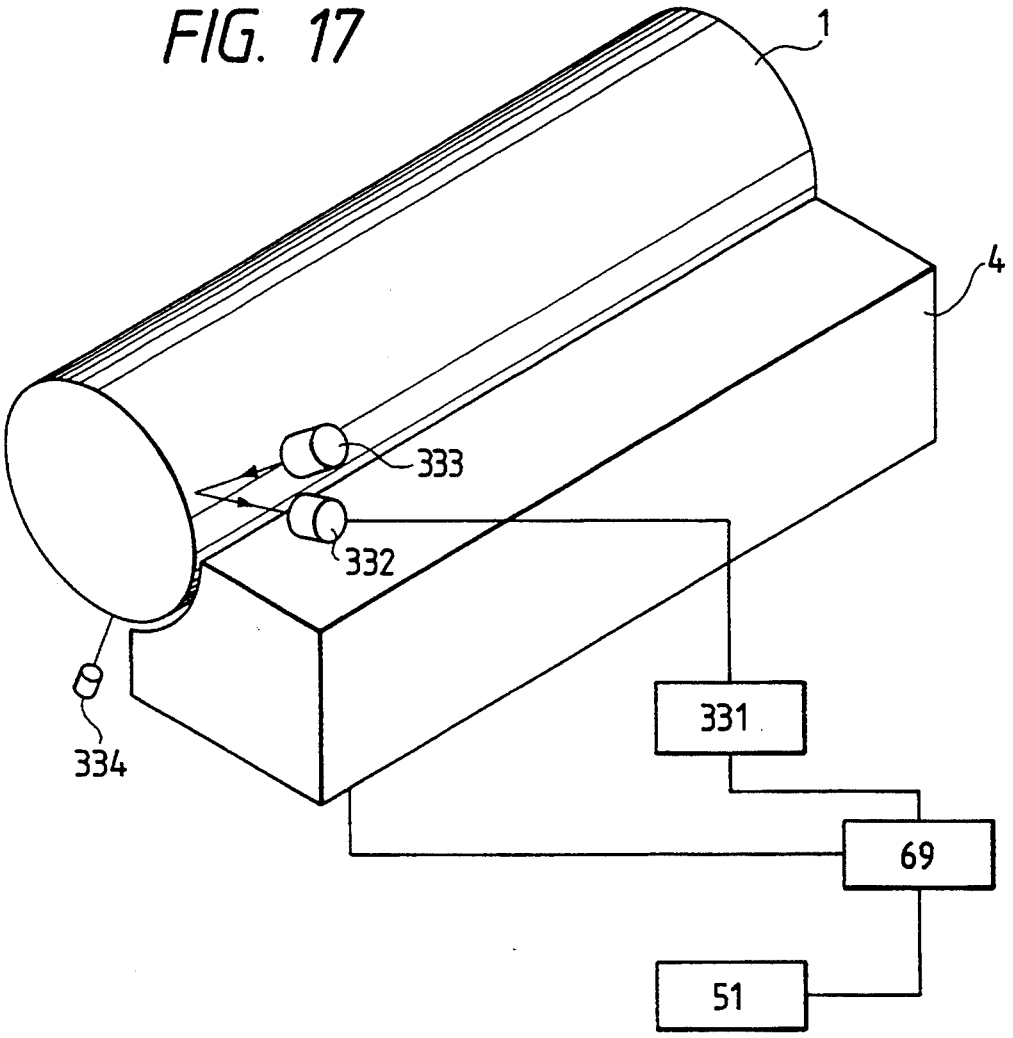
FIG. 17 is a view illustrating a controller for a regulator valve of the apparatus of FIG. 14.

The part of the development slot 272 at the end of the head 255 is the detection slot 330. The width of the detection slot 330 is larger than that of the other part of the slot 272. Since the wet developer 320 is retained in the slot 272 due to a capillary force, the developer disappears from the detection slot 330 if the quantity of the developer in the slot 272 decreases. As shown in FIG. 17, the thickness of the wet developer applied to the photosensitive drum 1 is monitored through the use of a light emitter 333 and a light receiver 332 at the portion of the drum, which corresponds to the detection slot 330. After the peripheral surface of the drum 1 is exposed to the light from an exposure lamp 334 so as to have a potential nearly equal to ground potential, the developer is applied to the surface by the development apparatus 4. After the developer on the surface is put into contact with the development roller 303, the developer finally clings to the surface. The reflectance of the developer on the peripheral surface of the drum 1 after contact depends on the thickness of the developer, so that the quantity of light received by the light receiver 332 from the light emitter 333 varies. When the reflectance has exceeded a predetermined value, the thickness of the developer is judged to be less than a prescribed value. In that case, the regulator valve 53 or 69 is controlled by a valve controller 331 so that the valve is opened for a prescribed time. A predetermined quantity of the developer is thus always fed and retained in the developer outflow slot 272 for stable development.

Figure 18:
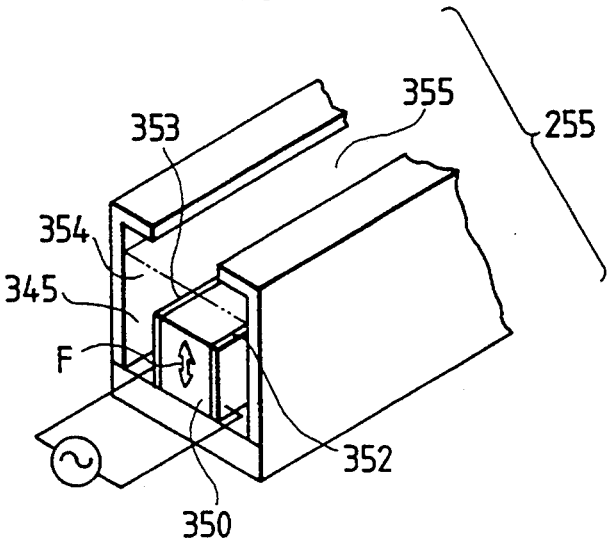
FIG. 18 is a perspective view of a developer application head of a wet development apparatus which is constructed according to another embodiment of the invention.

FIG. 18 shows the developer application head 255 of a wet development apparatus which is constructed according to yet another embodiment of the invention. The apparatus is the same as the preceding embodiment except for the developer application head 255.

The head 255, shown in FIG. 18, includes electrodes 352 and 353 which are provided on a piezoelectric ceramic plate 350. A wet developer 345 is accommodated in a cavity 354 and covers the ceramic plate 350. A high-frequency voltage is applied to the electrodes 352 and 353 to expand and compress the piezoelectric ceramic plate 350 in directions F to vibrate the plate to eject the wet developer from the developer outflow slot 355 of the head 255.

Figure 19:
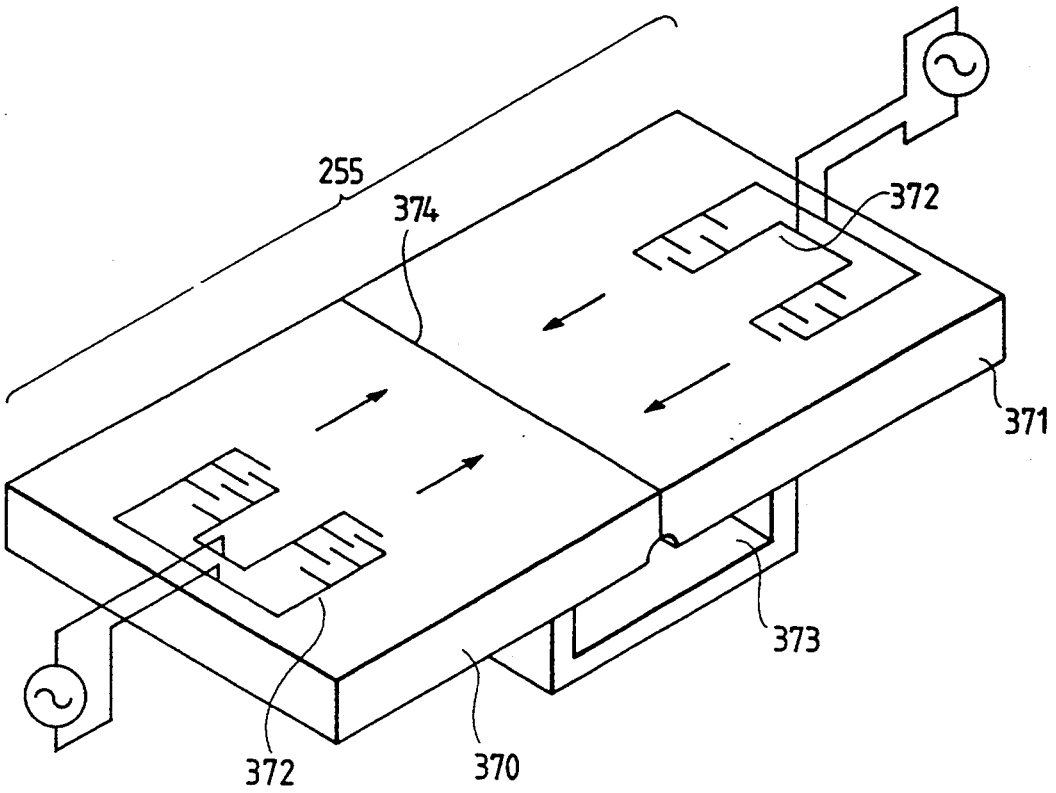
FIG. 19 is a perspective view of the developer application head of a wet development apparatus which is yet another embodiment of the invention.

FIG. 19 shows the developer application head 255 of a wet development apparatus of still another embodiment. The apparatus is the same as the immediately preceding embodiment, except for the developer application head 255. In the head 255 shown in FIG. 19, comb-like electrodes 372 for building an elastic surface wave resonator are provided on the finely finished propagation surfaces of propagation plates 370 and 371, each made of a Y-cut piezoelectric single crystal of $LiNbO_3$. The propagation plates 370 and 371 are opposed to each other across a developer outflow slot 374 under or behind which a cavity 373 is provided. When a wet developer is filled into the cavity 373, the developer enters the slot 374 due to capillary force. When a high-frequency voltage is applied to the electrodes 372, elastic surface waves are generated and are propagated in the propagation surfaces of the propagation plates 370 and 371 so that the waves vibrate the slot 374 and cause the wet developer to be sprayed as droplets, each having a diameter of 1 to 100 μm.

The head 255 performs a scanning movement in a direction G to feed the developer to the peripheral surface of the drum 1 in a uniform manner. The developer is thus fed in an appropriate quantity and a uniform manner to the drum 1.

In a wet development apparatus constructed in accordance with the present invention, a wet developer is ejected as minute droplets from a developer application head and applied to an electrostatic latent image carrier. Therefore, the viscosity of the developer does not need to be kept as low as in a conventional device in which the charged grains of the toner of a developer electrophoretically move in the carrier liquid thereof so as to cling to an electrostatic latent image carrier. Therefore, the quantity of the developer necessary for forming an image can be reduced, and the apparatus can be made smaller. In other words, the viscosity of the developer can be made higher. Moreover, a developer application head and the electrostatic latent image carrier can be disposed at such a distance from each other that it is easy to keep the distance accurate.

According to the present invention, an electrostatic latent image can be rendered visible with a developer whose carrier liquid content is reduced. Therefore, the volume of the developer can be decreased to reduce the size of developer storage space, thereby reducing the size of the imaging machine as a whole.

There has thus been shown and described a novel wet development apparatus and method which fulfills all the objects and advantages sought therefor. Many changes, modifications, variations, and other uses and applications of the subject invention will, however, become apparent to those skilled in the art after considering the specification and the accompanying drawings which disclose preferred embodiments thereof. All such changes, modifications, variations, and other uses and applications which do not depart from the spirit and scope of the invention are deemed to be covered by the invention which is limited only by the claims which follow.

What is claimed is:

1. A wet recording machine for forming a toner image corresponding to an electrostatic latent image on an electrostatic latent image carrier using a wet developer, comprising:

an elastic drum which is in rotatable contact with said image carrier, said elastic drum comprising a metal sleeve, an electroconductive elastic layer circumscribing said sleeve and an insulating outermost layer;

a developer application means for applying said wet developer to an electroconductive portion of said elastic drum at a position proximate to where said drum contacts said carrier thereby forming said toner image on said drum, said position being immediately upstream of said elastic drum and said image carrier; and means for transferring said toner image from said drum to a recording medium.

2. The wet recording machine as recited in claim 1, wherein a predetermined potential is applied to said electroconductive portion.

3. The wet recording machine as recited in claim 1, wherein said transferring means includes a pressure roller in contact with said elastic drum, said recording medium being conveyed therebetween, wherein a first imaginary line connecting the centers of said electrostatic latent image carrier and said elastic drum, and a second imaginary line connecting the centers of said elastic drum and said pressure roller do not form a 180 degree angle.

4. A wet recording method for recording a toner image on to a recording paper using a wet developer, comprising the steps of:

forming an electrostatic latent image on an electrostatic latent image carrier;

rotating a drum which is in contact with said carrier and which includes a metal sleeve, an electroconductive elastic layer circumscribing the sleeve and an insulating outermost layer;

applying a predetermined potential to said electroconductive elastic layer of said elastic drum;

spraying wet developer to an upstream position where said carrier and said elastic drum come into contact with each other forming a toner image on said drum which corresponds to said electrostatic image on said carrier;

placing a recording material into contact with said elastic drum;

applying pressure to said paper by a pressure roller to place said paper into contact with said drum; and transferring said toner image to said paper.

5. A wet development apparatus, comprising:

a photosensitive drum:

means for forming an electrostatic latent image on the peripheral surface of said drum;

an elastic drum which is in rotatable contact with said peripheral surface of said photosensitive drum, said elastic drum including a metal sleeve, an electroconductive elastic layer circumscribing said sleeve and an insulating outermost layer;

wet developer application means for applying wet developer to a surface of said elastic drum;

means for maintaining said elastic drum at a predetermined potential with respect to said photosensitive drum such that a toner image corresponding to said latent image is transferred to said elastic drum; and means for transferring said toner image from said elastic drum to a recording medium.

* * * * *